US010519736B2

(12) United States Patent
Sokolove et al.

(10) Patent No.: US 10,519,736 B2
(45) Date of Patent: Dec. 31, 2019

(54) EXPLODING BRIDGE WIRE DETONATION WAVE SHAPER

(71) Applicant: Hunting Titan, Inc., Pampa, TX (US)

(72) Inventors: Christopher Brian Sokolove, Maypearl, TX (US); Faraidoon Pundole, Sugar Land, TX (US)

(73) Assignee: Hunting Titan, Inc., Pampa, TX (US)

( * ) Notice: Subject to any disclaimer, the term of this patent is extended or adjusted under 35 U.S.C. 154(b) by 124 days.

(21) Appl. No.: 15/325,303

(22) PCT Filed: Jul. 10, 2015

(86) PCT No.: PCT/US2015/039897
§ 371 (c)(1),
(2) Date: Jan. 10, 2017

(87) PCT Pub. No.: WO2016/007829
PCT Pub. Date: Jan. 14, 2016

(65) Prior Publication Data

US 2017/0191328 A1 Jul. 6, 2017

Related U.S. Application Data

(60) Provisional application No. 62/022,751, filed on Jul. 10, 2014.

(51) Int. Cl.
*E21B 29/02* (2006.01)
*E21B 43/117* (2006.01)
(Continued)

(52) U.S. Cl.
CPC ..... *E21B 29/02* (2013.01); *E21B 43/117* (2013.01); *E21B 43/1185* (2013.01);
(Continued)

(58) Field of Classification Search
CPC .... E21B 29/02; E21B 43/117; E21B 43/1185; F42B 1/02; F42B 3/10; F42B 3/12; F42B 3/124; F42B 3/22
(Continued)

(56) References Cited

U.S. PATENT DOCUMENTS 2,086,527 A * 7/1937 Aughey ..... F42B 3/18 102/202.11
2,839,997 A * 6/1958 Church ..... F42B 12/14 102/307
(Continued)

FOREIGN PATENT DOCUMENTS

GB 2409717 A 7/2005
WO 2016007829 A1 1/2016

OTHER PUBLICATIONS

Notification of transmittal of the international search report and written opinion of the international searching authority, PCT Application No. PCT/US15/39897, dated Oct. 1, 2015, 10 pages.
(Continued)

*Primary Examiner* — Samir Abdosh
(74) *Attorney, Agent, or Firm* — Arnold & Saunders, LLP; Christopher McKeon; Jason Saunders

(57) ABSTRACT

A jet cutter apparatus and method for using a single bridge wire or a plurality of bridge wires to uniformly detonate a booster and thereby cause a uniform detonation of the explosives adjacent to the liners, thereby causing a uniform compression of the liners to form a uniform plasma jet that is substantially radially perpendicular to the jet cutter.

14 Claims, 5 Drawing Sheets

(51) Int. Cl.

| | |
|---|---|
| ***E21B 43/1185*** | (2006.01) |
| ***F42B 1/028*** | (2006.01) |
| ***F42B 3/12*** | (2006.01) |
| ***F42B 3/22*** | (2006.01) |

(52) U.S. Cl.
CPC ..... *F42B 1/028* (2013.01); *F42B 3/12* (2013.01); *F42B 3/124* (2013.01); *F42B 3/22* (2013.01)

(58) Field of Classification Search
USPC ..... 102/306
See application file for complete search history.

(56) References Cited

U.S. PATENT DOCUMENTS

| | | | | | |
|---|---|---|---|---|---|
| 3,208,379 | A | | 9/1965 | McKee et al. | |
| 3,457,859 | A | | 7/1969 | Guenter | |
| 3,742,856 | A | | 7/1973 | Welanetz | |
| 4,018,293 | A | * | 4/1977 | Keller | E21B 43/263 102/307 |
| 4,788,913 | A | * | 12/1988 | Stroud | F42B 3/11 102/202.5 |
| 5,505,134 | A | * | 4/1996 | Brooks | E21B 43/1185 102/202.7 |
| 5,859,383 | A | | 1/1999 | Davison et al. | |
| 6,761,116 | B2 | * | 7/2004 | Daoud | C06C 7/00 102/202.14 |
| 7,661,367 | B2 | * | 2/2010 | Yang | F42B 3/08 102/306 |
| 8,561,683 | B2 | * | 10/2013 | Wood | E21B 29/02 166/63 |
| 2009/0266259 | A1 | * | 10/2009 | Rustick | F42B 3/12 102/202.5 |
| 2012/0234193 | A1 | * | 9/2012 | Tirmizi | F42B 3/125 102/202.7 |
| 2014/0083718 | A1 | | 3/2014 | Bell | |
| 2017/0191328 | A1 | | 7/2017 | Sokolove et al. | |

OTHER PUBLICATIONS

Notification concerning transmittal of international preliminary report on patentability, PCT Application No. PCT/US15/39897, dated Jan. 19, 2017, 9 pages.
Supplementary European Search Report, EP15818654, dated Jan. 18, 2018, 7 pages.
Canadian Office action dated Dec. 6, 2017, CA application No. 2,948,664, 3 pages.
Response to Canadian Office action dated Jun. 5, 2018, CA application No. 2,948,664, 13 pages.
Communication pursuant to article 94(3) EPC, EP15818654, dated Mar. 5, 2019, 9 pages.

* cited by examiner

EXPLODING BRIDGE WIRE DETONATION WAVE SHAPER

RELATED APPLICATIONS

This application is the non-provisional of U.S. Provisional Application No. 62/022,751, filed Jul. 10, 2014.

FIELD OF INVENTION

The invention generally relates to methods and apparatus for controlling the shape of a detonation wave. In some aspects the invention relates to jet cutters utilizing explosive materials. More particularly, the invention relates to shaped charge explosive devices designed primarily for cutting tubulars in a well, including but not limited to casing, tubing, piping, and liners.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Combinations of different tubulars may be lowered into a well for a multitude of purposes.

When placing any type of tubular downhole there is a risk that it can get stuck in the well. This can happen for several reasons including: the well has partially collapsed, operator error, or due to the geometry of the drilling path. Once the tubular becomes stuck, a variety of non-destructive means are available for the operator of the rig to try and free the tubular. These include rotating the tubular, jolting the tubular, or simply pulling up on the tubular until it comes free. However, if these options are unsuccessful then the operator might have to resort to using a cutting or severing tool such as a jet cutter to cut the tubular.

Tubulars may also be cut in abandonment operations. Abandonment operations are increasingly subject to regulations for minimizing the long term environmental impact of abandoned wells. An operator will often times have to remove miles of tubulars while contending with cemented equipment, damage in the wellbore, or other unforeseen difficulties. The jet cutter is a critical tool that allows the operator to cut and retrieve tubulars from the well. The demand for cleaner abandoned wells, in conjunction with the growing number of idle wells in general, is a driving force in the market for jet cutters.

A jet cutter is an explosive shaped charge that has a circumferential V-type shape. The explosive is combined with a liner. The components are all contained in a housing. The jet cutter is lowered to the point where the separation of the tubular is desired. When the jet cutter is detonated, it will generate a jet of high energy plasma, typically in a 360 degree arc, that will severe the tubular. Afterwards, the upper portion of the tubular is pulled out of the well. Then the operator can use a fishing tool to remove the lower portion of the tubular.

While other types of tubular cutters are available, including mechanical cutting devices and chemical cutters, one application of this invention is on explosive shaped charge jet cutters that are widely used throughout the oil industry.

A shaped charge is a term of art for a device that when detonated generates a focused explosive output. This is achieved in part by the geometry of the explosive in conjunction with a liner in the explosive material. Many materials are used for the liner, some of the more common metals include brass, copper, tungsten, and lead. When the explosive detonates the liner metal is compressed into a super heated, super pressurized jet that can penetrate metal, concrete, and rock.

The shaped charge explosives in jet cutters are typically detonated by a booster explosive located in a central cavity coaxial with the shaped charge. This booster is typically detonated from the top, causing a detonation wave to travel down the booster longitudinally. The longitudinal component of the detonation can cause deflection of the shaped charge jet from the ideal, purely radial, direction. The longitudinal deflection of the cutting jet can reduce the effectiveness of the cutter and cause a curved or cupped cut in the target tubular. A device that could detonate a jet cutter booster along its entire length simultaneously would remove any off-axis components of the shaped charge jet.

SUMMARY OF EXAMPLES OF THE INVENTION

An example of the invention may include a detonation wave shaper comprising an explosive pellet and an exploding bridge wire contained within the explosive pellet. A variation of the example may include the explosive pellet being substantially cylindrical in shape. The exploding bridge wire may be substantially coaxial with the explosive pellet cylinder. The exploding bridge wire may extend through most of the length of the explosive pellet cylinder. The invention may further comprise a shell surrounding the explosive pellet. The shell may be composed of a conductive material and the first end of the exploding bridge wire may be electrically connected to the shell. A second end of the exploding bridge wire may be adapted to electrically connect to a fireset.

Another example of the invention may include a shaped charge tubing cutter comprising a substantially cylindrical housing, a shaped charge explosive having an explosive and a liner, a detonation wave shaper comprising an explosive pellet and an exploding bridge wire contained within the explosive pellet, wherein the detonation wave shaper fits in a cavity in the center of the shaped charge explosive. A variation of the invention may include the detonation wave shaper further comprising a substantially cylindrical shell encasing the explosive pellet, wherein the exploding bridge wire is substantially coaxial with the explosive pellet.

Another example of the invention may include a detonation wave shaper comprising an explosive pellet and a plurality of exploding bridge wire segments within the explosive pellet. A variation of the example may include the explosive pellet being substantially cylindrical in shape. The exploding bridge wire segments may be substantially coaxial with the explosive pellet cylinder. The exploding bridge wire segments may be arranged substantially end-to-end and extend through most of the length of the explosive pellet cylinder. The example may further comprise a shell surrounding the explosive pellet. The shell may be comprised of a conductive material and a first end of the exploding bridge wire segments that is electrically connected to the shell. A second end of the exploding bridge wire segments may be adapted to electrically connect to a fireset. The exploding bridge wire segments may be mounted on a printed circuit board. The explosive pellet may be substantially cylindrical in shape. The exploding bridge wire segments may be substantially coaxial with the explosive pellet cylinder. The exploding bridge wire segments may be arranged substantially end-to-end and extend through most of the length of the explosive pellet cylinder. The exploding bridge wire segments may be mounted on alternate sides of the printed circuit board from a first end of the printed circuit board to a second end of the printed circuit board.

BRIEF DESCRIPTION OF THE DRAWINGS

For a thorough understating of the present invention, reference is made to the following detailed description of the preferred embodiments, taken in conjunction with the accompanying drawings in which reference numbers designate like or similar elements throughout the several figures. Briefly.

DETAILED DESCRIPTION OF THE DRAWINGS

In the following description, certain terms have been used for brevity, clarity, and examples. No unnecessary limitations are implied and such terms are used for descriptive purposes only and are intended to be broadly construed. The different apparatus and method steps described herein may be used alone or in combination with other systems and method steps. It is to be expected that various equivalents, alternatives, and modifications are possible within the scope of the appended claims.

Figure 1:
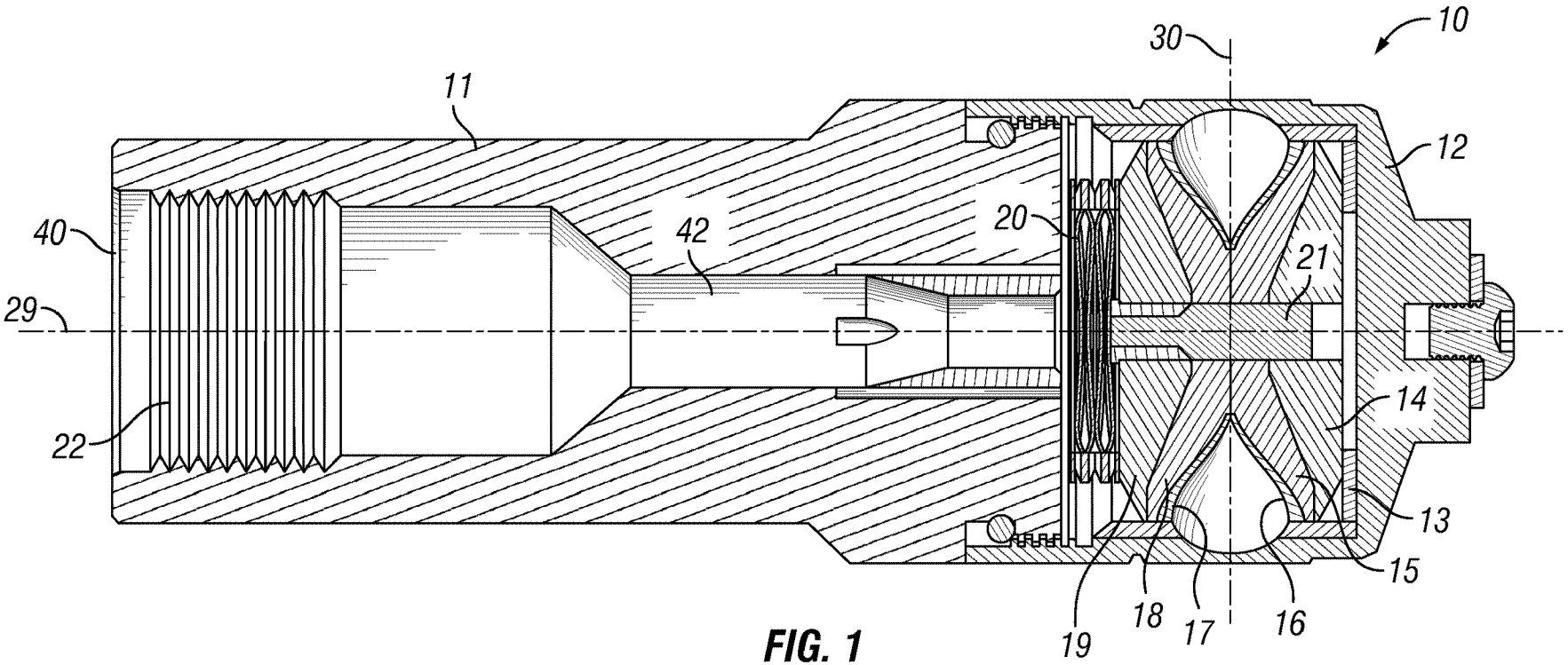
FIG. 1 is an axial cross-section of an example jet cutter.

FIG. 1 illustrates an example jet cutter 10 containing an upper housing 11 and a lower housing 12. The lower housing 12 contains a first compression device 13, a first backer plate 14, a first explosive material 15, a first liner 16, a second liner 17, a second explosive material 18, a second backer plate 19, and a second compression device 20. The lower housing 12 also contains an explosive booster 21 used to initiate the first explosive material 15 and second explosive material 18. Liners 16 and 17 may be composed of combinations of metals including brass, copper, tungsten, and lead.

Existing oilfield pipe cutters are initiated with a typical 50 Ohm detonator placed in close proximity to the booster 21. As the detonation wave propagates through the booster 21, it advances along the cutter axis 29 downwards, with the lower housing 12 being considered lower than the upper housing 11. This advance of detonation wave is collinear to the axis 29 and perpendicular to the liner axis 30. The perpendicular motion of the detonation wave causes the detonation of the second explosive material 18 before the first explosive material 15, causing the asymmetric collapse of the first liner 16 and second liner 17. Ideally, both the first explosive material 15 and the second explosive material 18 would explode at exactly the same time. The result of asymmetric detonation is that the pipe is cut in a curved shape 81, see FIG. 7*a* as opposed to a desired straight perpendicular cut 83 in FIG. 7*b*.

A curved cut is undesirable for several reasons. First, the top of the curved cut typically exhibits greater flare or expansion of the pipe near the cut. Second, the shortest and most efficient cut is exactly perpendicular to the pipe. Straightening out the profile of the cut could increase the depth of the cut for thicker pipe.

Figure 2:
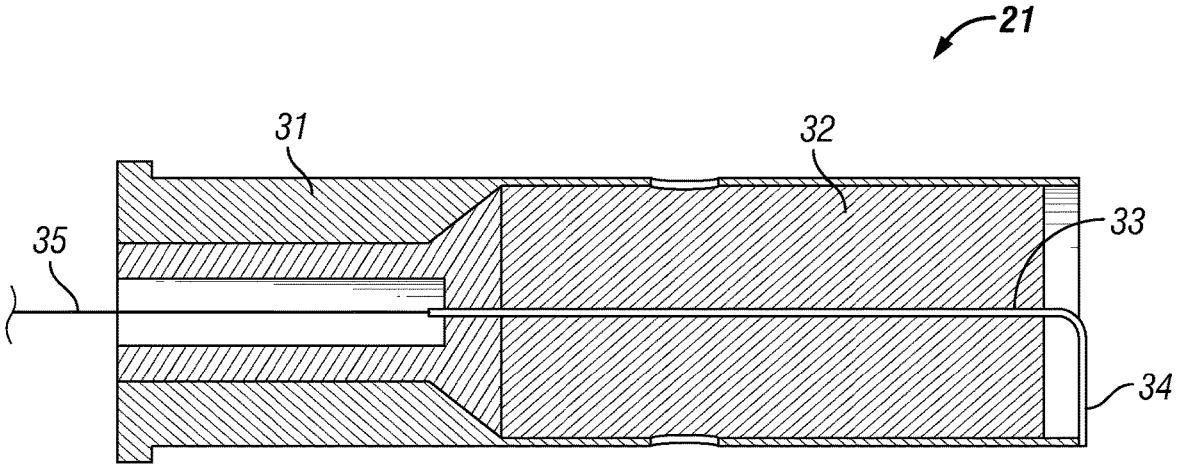
FIG. 2 is an axial cross-section of an example booster.

An exploding bridge wire wave shaper, as depicted in FIG. 2, can be used to create a perpendicular cutting jet. The booster 21 has a shell 31 and an explosive pellet 32. A bridge wire 33 is placed in the center of explosive pellet 32 and shell 31. The bridge wire 33 is confined by the pressed explosive pellet 32. The bridge wire 33 is terminated at end 34 against the shell 31. A booster shell 31 in this example is composed of a conductive material, such as brass. The other end of the bridge wire 33 is electrically connected to a wire 35 that is further electrically connected to a fireset or power source (not shown) that provides the electrical discharge needed to burst or explode the bridge wire 33. When current is applied from the fireset the bridge wire 33 explodes. This explosion causes the explosive pellet 32 to explode along its entire length. The explosion then moves out radially, allowing for the detonation of the explosive material 15 and 18 at the same time. The simultaneous detonation of explosive material 15 and 18 causes the first liner 16 and second liner 17 to collapse on each other simultaneously as well.

Figure 3:
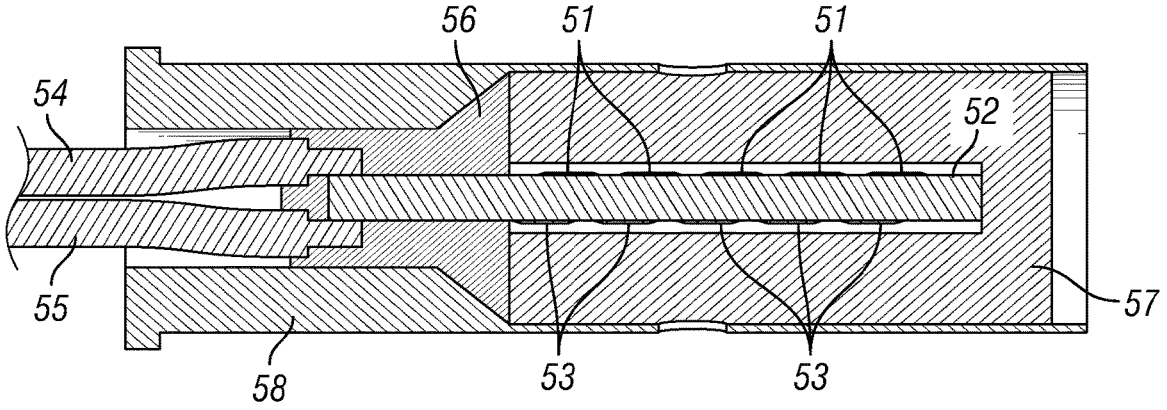
FIG. 3 is an axial cross-section of an example booster.

Another example of the invention is shown in FIG. 3 using a shorter, discontinuous bridge wire sections electrically connected in parallel. In this example there are bridge wire segments 51 and 53, located 180 degrees from each other. The bridge wire segments 51 and 53 are mounted onto a printed circuit board (PCB) 52. The bridge wire segments may be soldered into place on the PCB 52. Furthermore, in this example the segments 51 are offset from the segments 53. However, one skilled in the art will appreciate that more than two sets of bridge wire segments can be used. For instance, there could be four bridge wire segments located radially 90 degrees from one set to the next. Furthermore, in this example there are shown five bridge wire segments 51 and five bridge wire segments 53. However, more or less than five bridge wire segments may be used. In this example, there are two sets of bridge wire segments 51 and 53, but there can be variations on this design including a single set of bridge wire segments or a plurality of more than two sets of bridge wire segments.

Figure 4:
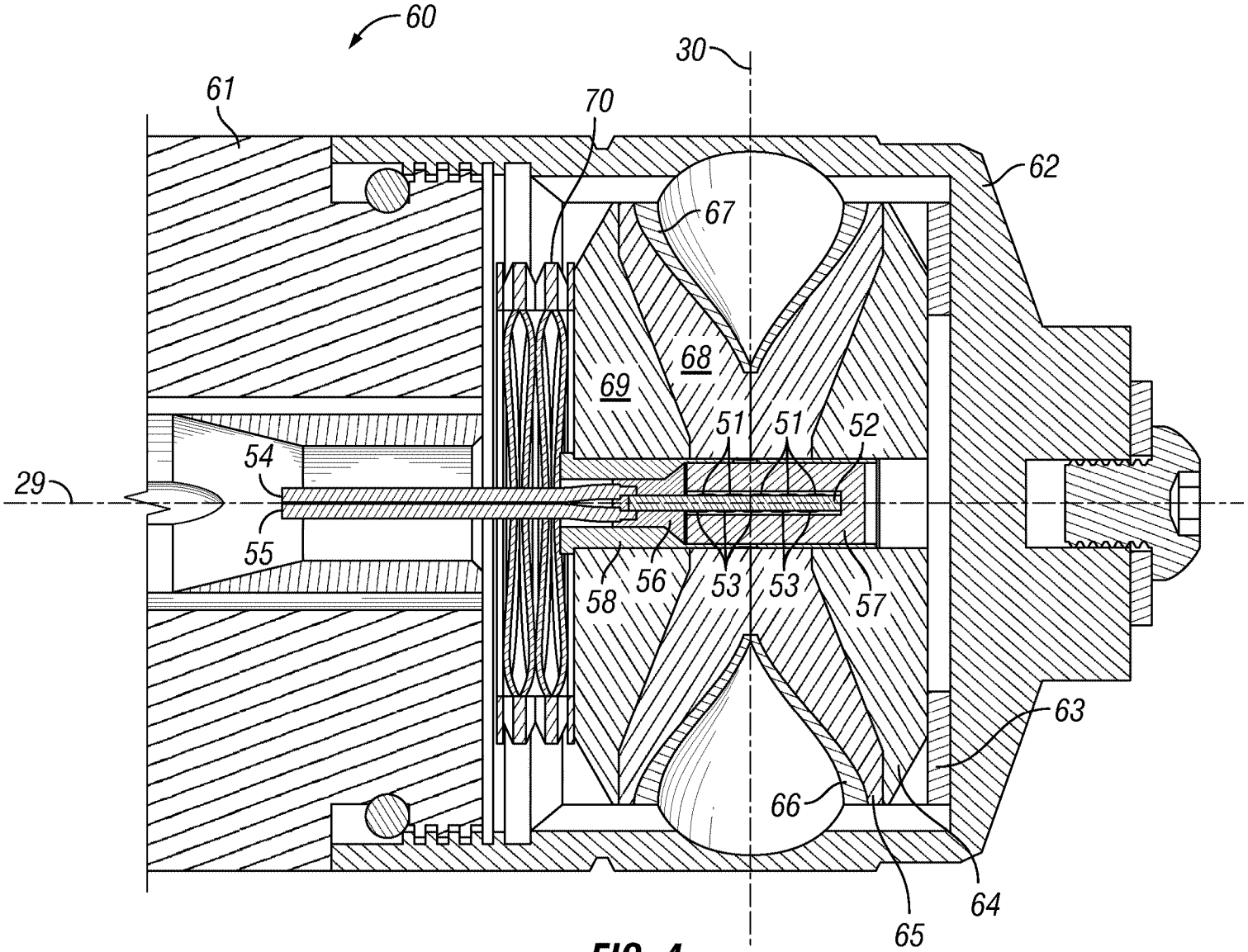
FIG. 4 is an axial cross-section close up of an example jet cutter.
Figure 7A:
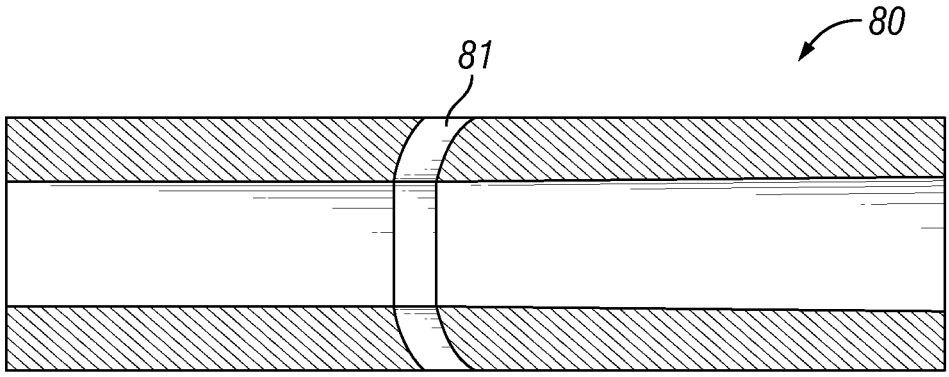
FIG. 7*a* is a view of a tubular with a curved cut.
Figure 7B:
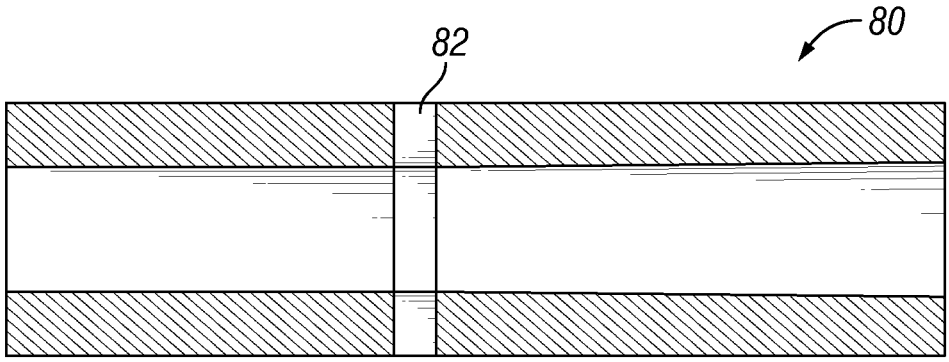
FIG. 7*b* is a view of a tubular with a straight cut.

The discontinuous bridge wire design of FIG. 3 can be installed into a jet cutter as shown in FIG. 4. The leads 54 and 55 eventually connect to a fireset (not shown) that will use an electrical discharge to explode the bridge wire segments 51 and 53. The fireset will send a signal to the PCB 52 via leads 54 and 55. The signal will explode the bridge wire segments 51 and 53. The explosion will cause the explosive pellet 57 to detonate outwards radially. The explosion will travel radially in a substantially uniform fashion such that the explosive wave contacts the radial edges of explosives 65 and 68 at substantially the same the time. The explosives 65 and 68 will then start detonating from the inside out. As the explosive wave travels through explosives 65 and 68 it will begin subjecting liners 66 and 67 to high intensity heat and pressure at substantially the same time. The liners 66 and 67 will be crushed inwards and converted into a plasma jet that explodes outwards radially along axis 30. The plasma jet will cut through the lower housing 62 and then cut the surrounding tubular 80 as shown in FIG. 8*b*. The uniformity of detonation of the booster explosive pellet 57, followed by the uniform detonation of the explosives 65 and 68, combine to cause the near simultaneous compression of both liners 66 and 67. The near simultaneous compression of both liners 66 and 67 result in a straight cut in the tubular 82 as shown in FIG. 7B compared with the prior art which causes a curved cut 81 as shown in FIG. 7A.

Figure 5:
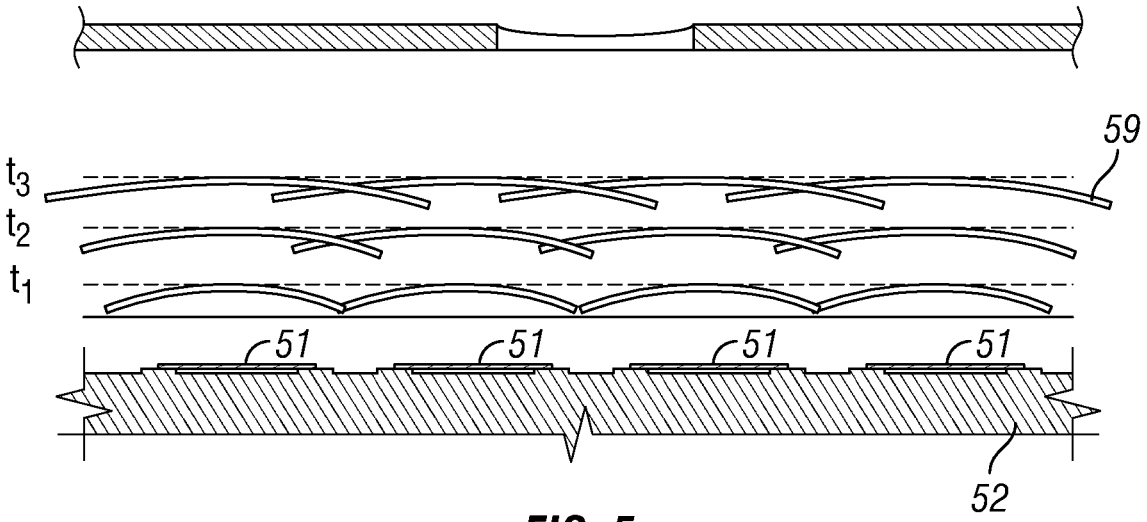
FIG. 5 is a depiction of the explosive wave moving perpendicular to bridge wire segments.

When the bridge wire segments 51 burst, as shown in FIG. 5, they will produce shock waves 59 that will travel substantially perpendicular to the PCB 52. The shock waves 59 will travel at the same speed such that with each time interval, t1, t2, and t3, the shock waves stay roughly the same perpendicular distance from their originating bridge wire segment 51.

Figure 6:
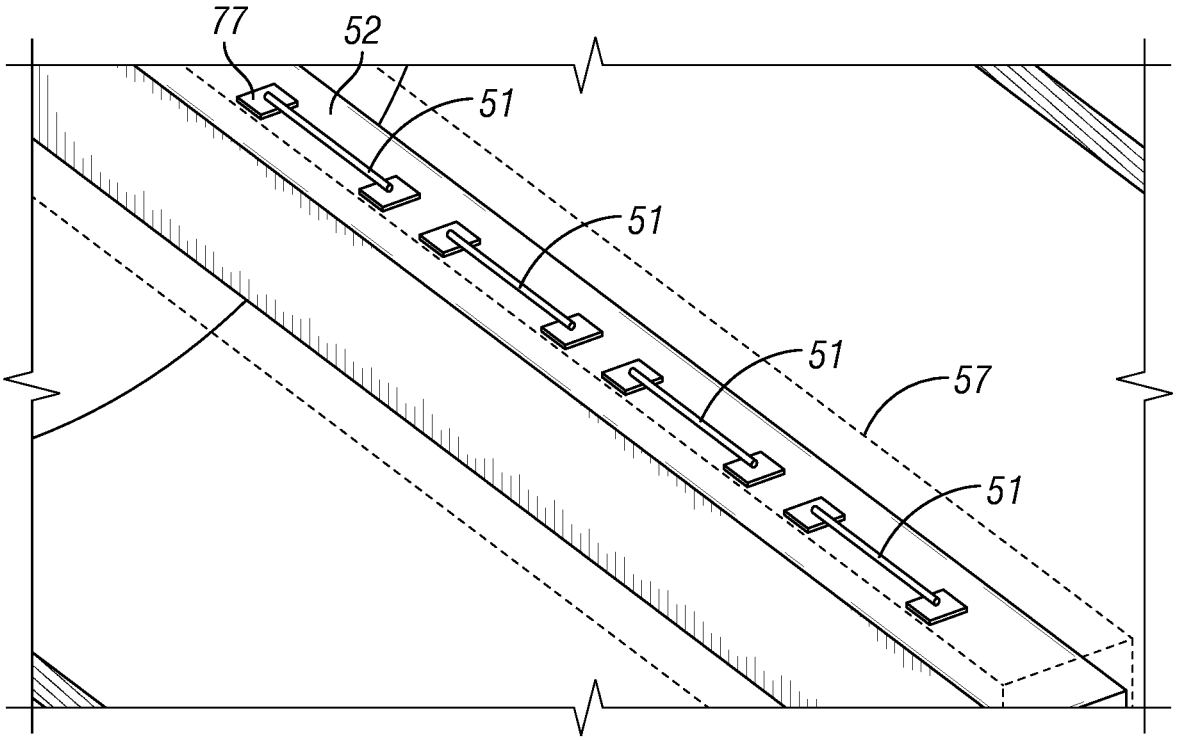
FIG. 6 is a view of the bridge wires mounted onto a printed circuit board inside a booster.

Another example of the discontinuous bridge wire design is shown in FIG. 6. The PCB 52 is located within the booster explosive pellet 57. The bridge wire segments 51 are mounted onto the PCB 52 using contact pads 77. When a detonation signal is sent from a fireset the individual bridge wire segments 51 each explode or burst, causing explosive pellet 57 to detonate at a plurality of locations simultaneously. The design allows for the plurality of detonation points to ensure that the explosive waves are no longer biased to one end of the booster or the other.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A detonation wave shaper comprising:

an explosive pellet a cylindrical shaped body and an inner hollow portion;

a printed circuit board located within the inner hollow portion;

a plurality of exploding bridge wire segments mounted onto the printed circuit board in at least one series, wherein the exploding bridge wire segments are contained within the explosive pellet and upon detonation creates a radial shock wave perpendicular to the printed circuit board and uniform along the length of the plurality of bridge wire segments.

2. The detonation wave shaper of claim 1 wherein the explosive pellet is substantially cylindrical in shape.

3. The detonation wave shaper of claim 2 wherein the exploding bridge wire is substantially coaxial with the explosive pellet cylinder.

4. The detonation wave shaper of claim 2 wherein at least one series of exploding bridge wire segments extends through most of the length of the explosive pellet cylinder.

5. The detonation wave shaper of claim 1 further comprising a shell surrounding the explosive pellet.

6. The detonation wave shaper of claim 5 wherein the shell is comprised of a conductive material and a first end of the exploding bridge wire is electrically connected to the shell.

7. The detonation wave shaper of claim 6 wherein a second end of the exploding bridge wire is adapted to electrically connect to a fireset.

8. A detonation wave shaper comprising:

a substantially cylindrically shaped explosive pellet; and a plurality of exploding bridge wire segments mounted on a printed circuit board in a first series within the explosive pellet, wherein the bridge wire firing creates a substantially uniform shockwave in radial propagation and thickness, and wherein the exploding bridge wire segments are mounted on alternate sides of the printed circuit board from a first end of the printed circuit board to a second end of the printed circuit board.

9. The detonation wave shaper of claim 8 wherein the exploding bridge wire segments are substantially coaxial with the explosive pellet cylinder.

10. The detonation wave shaper of claim 8 wherein the exploding bridge wire segments are arranged substantially end-to-end and extend through most of the length of the explosive pellet cylinder.

11. The detonation wave shaper of claim 8 further comprising a shell surrounding the explosive pellet.

12. The detonation wave shaper of claim 11 wherein the shell is comprised of a conductive material and a first end of the exploding bridge wire segments is electrically connected to the shell.

13. The detonation wave shaper of claim 12 wherein a second end of the exploding bridge wire segments is adapted to electrically connect to a fireset.

14. The detonation wave shaper of claim 8 wherein the detonation wave shaper further comprises a substantially cylindrical shell encasing the explosive pellet, wherein the exploding bridge wire is substantially coaxial with the explosive pellet.

* * * * *